United States Patent [19]

Shestak et al.

[11] Patent Number: 4,639,700

[45] Date of Patent: Jan. 27, 1987

[54] CIRCUIT INTERRUPTER WITH SHOCK RESISTANT MECHANISM

[75] Inventors: Edward J. Shestak, Penn Hills Township, Allegheny County; David Marschik, Wilkens Township, Allegheny County, both of Pa.

[73] Assignee: Westinghouse Electric Corp., Pittsburgh, Pa.

[21] Appl. No.: 831,034

[22] Filed: Feb. 19, 1986

[51] Int. Cl.[4] ..... H01H 77/00

[52] U.S. Cl. ..... 335/6; 335/15; 335/63; 335/157

[58] Field of Search ..... 335/6, 15, 16, 63, 157

[56] References Cited

U.S. PATENT DOCUMENTS

| | | | |
|---|---|---|---|
| 4,266,209 | 5/1981 | DiMarco et al. | 335/6 |
| 4,539,538 | 9/1985 | Flick et al. | 335/16 |
| 4,540,961 | 9/1985 | Maier | 335/16 |

*Primary Examiner*—Peter S. Wong
*Assistant Examiner*—Mark D. Simpson
*Attorney, Agent, or Firm*—L. P. Johns

[57] ABSTRACT

A circuit interrupter with shock resistant mechanism characterized by a circuit breaker/contactor device in combination with an electromagnetic actuator which comprises a pair of opposed and facing solenoids having aligned armatures for actuating a linkage to open and close contacts of the circuit breaker contactor, and the linkage having a coupler link for movement between co-linear alignment with the armatures when the contacts are closed and for non-linearity when the contacts are open.

8 Claims, 7 Drawing Figures

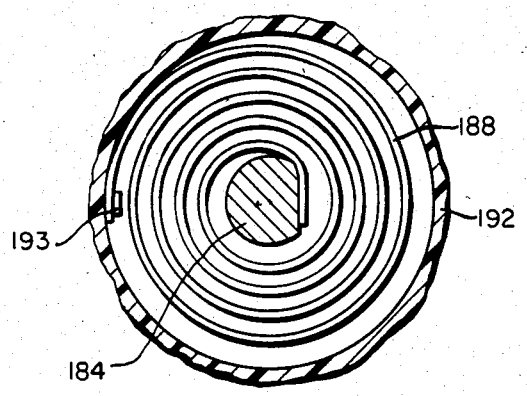
FIG. 4
FIG. 6
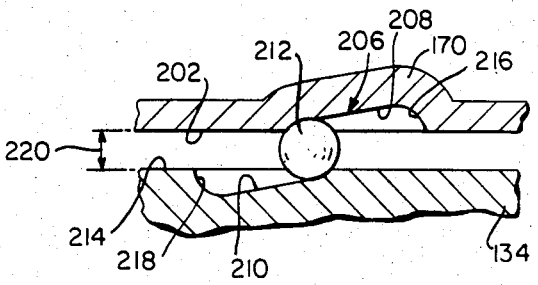
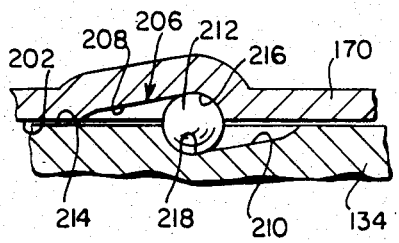
FIG. 5
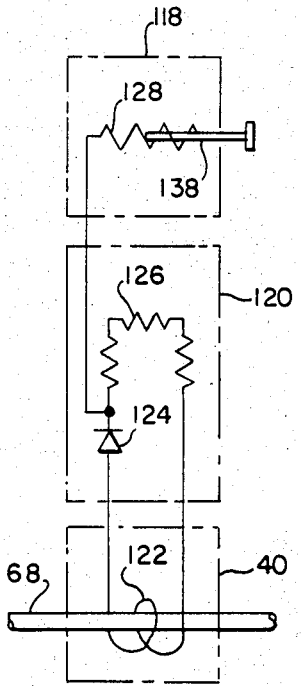
FIG. 7

CIRCUIT INTERRUPTER WITH SHOCK RESISTANT MECHANISM

GOVERNMENT RIGHTS STATEMENT

This invention was made in the course of, or under, Contract No. N00024-83-C-4181, by the Department of the Navy.

CROSS-REFERENCE TO RELATED APPLICATION

This application is related to the copending applications, Ser. No. 670,792 filed Nov. 13, 1984 entitled "Magnetically Operated Circuit Breaker" of which the inventors are C. J. Heyne and N. A. Tomasic; Ser. No. 670,792, filed Nov. 11, 1984, entitled "Circuit Breaker with Separable Modules", of which the inventors are W. V. Bratkowski and J. A. Wafer; and Ser. No. 759,718, filed July 29, 1985, entitled "Modular Integral Circuit Interrupter", of which the inventors are J. A. Wafer and K. A. Grunert, all assigned to the assignee of this application.

BACKGROUND OF THE INVENTION

1. Field of the Invention:

This invention relates generally to circuit breakers and, more particularly, to an integral circuit breaker/-contactor in which the contactor function is achieved with a rotary solenoid mechanism suitable for high shock environments.

2. Description of the Prior Art:

In designing equipment for military shipboard applications, the mechanical shock which it must withstand is one of the most important, and difficult, requirements to satisfy. The shock in service could be the result of nearby explosions or the firing of the ship's own armaments. In either case it is mandatory that the critical equipment and systems which allow the ship to continue functioning remain operable.

These shocks in service clearly necessitate proper strengthening of the pure structural components of both static and dynamic equipment, or else it could simply collapse upon itself. In addition to this strength consideration, a dynamic mechanism must account for the manner in which the shock forces interact with the mechanism's normal motive forces.

A contactor is an example of a commonly used device which includes a dynamic mechanism. In a normal commercial contactor, the moving contacts are operated by an electromagnet (solenoid) and spring which operate in a pure linear fashion. The solenoid is energized to move the contacts in one direction (typically to the closed position) and at the same time load the spring. When the solenoid is de-energized, the spring force returns the contacts to the opposite (open) position. This makes for a simple, inexpensive mechanism, but relatively low shock accelerations along the solenoid axis can cause the solenoid armature to move. Such unintentional actuation of the contactor could cause critical equipment to go out of service at a crucial moment.

SUMMARY OF THE INVENTION

In accordance with this invention a circuit interrupter is provided which comprises an electrically insulated housing, a circuit breaker having first and second seperable contacts operable between open and closed positions, the circuit breaker including a trip mehcanism having a releasable lever movable when released to a tripped position to cause automatic opening of the contacts, the first contact being mounted on a first arm coupled to the releasable lever, the second contact being mounted on a second arm of which at least a portion is substantially parallel to the first arm to cause current limiting repulsion of the contacts in response to overcurrent conditions, electromagnetic actuating means connected to the second arm for moving the second contact between open and closed positions of the first contact, the electromagnetic actuating means including a pair of solenoids with each solenoid having a coil and an armature within a solenoid case having an apertured end wall through which the armature extends, the armatures being in substantial alignment, each armature having an integrally mounted armature plate external of the case, rotary means between each armature plate and the end wall for rotating the armature plate when the armature moves longitudinally in response to operation of the armature coil, the armature plates being oppositely disposed having a common connection forming an assembly of the armature plates which is rotatable in tandem between first and second positions corresponding to the closed and open positions of the separable contacts, linkage means between the armature plates and the second contact arm and including a coupler link pivotally connected at one end to a common connection between the armature plates for movement with the plates and the longitudinal axis of the coupler link being in alignment with an axis extending through the common connection and the rotational axis of the plates when the plates are in the first position so as to resist opening of the contacts when the circuit interrupter is subjected to vibrational shock waves.

The advantage of the shock resistance mechanism of this invention is that it provides a unique and effective means for shock hardening a magnetic actuator which must endure a large number of operation cycles.

BRIEF DESCRIPTION OF THE DRAWINGS

FIG. 4 is an elevational view of a spiral spring, taken on the line IV—IV of FIG. 3;

FIG. 5 is a sectional view of a ball bearing race, taken on the line V—V of FIG. 1;

FIG. 6 is a sectional view of the ball bearing race in an alternate position, taken on the line VI—VI of FIG. 2; and FIG. 7 is a diagram of an electrical circuit for the trip unit and solenoid.

DESCRIPTION OF THE PREFERRED EMBODIMENTS

Figure 1:
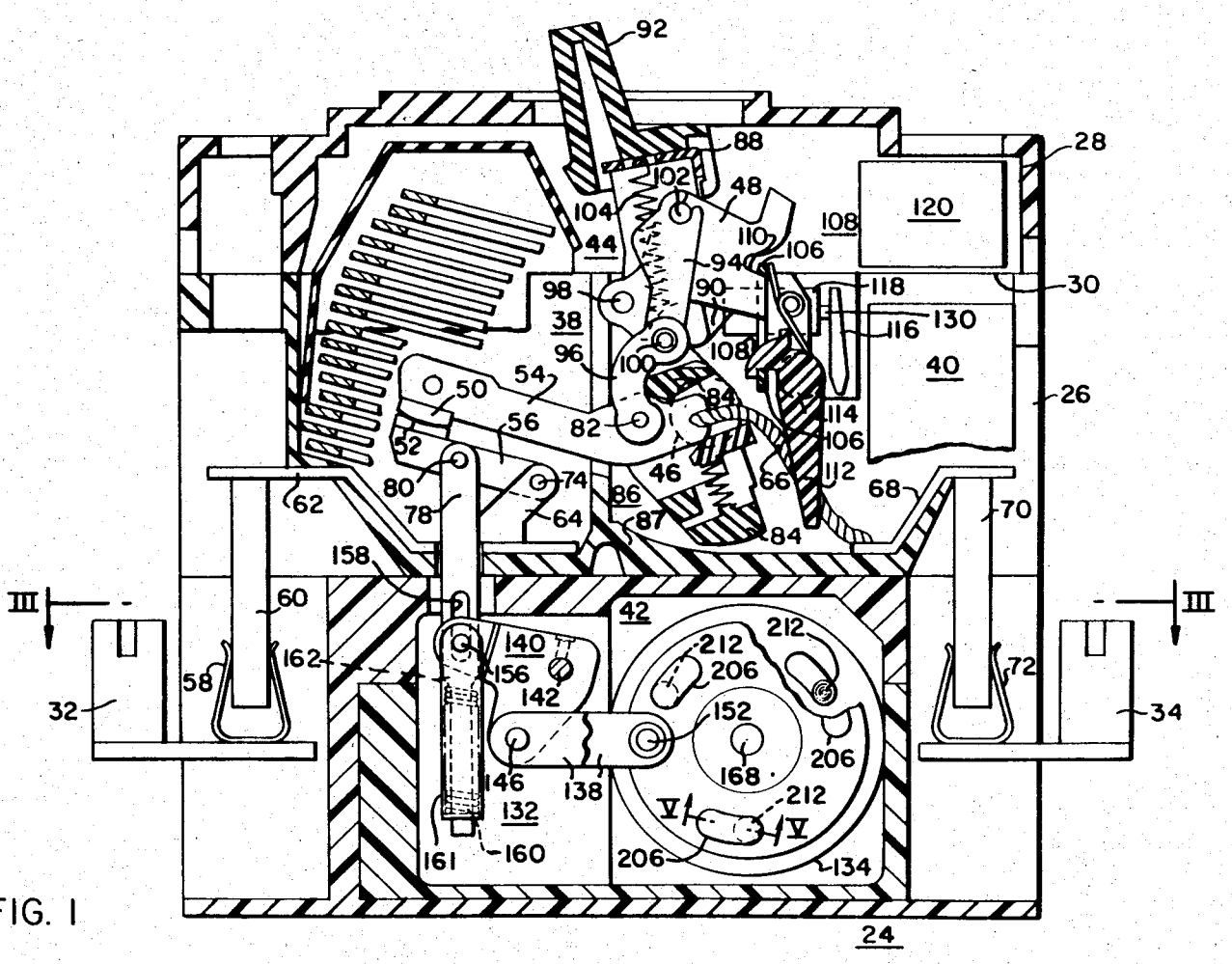
FIG. 1 is a vertical sectional view of a circuit interrupter in the closed circuit condition, taken on the line I—I of FIG. 3.
Figure 2:
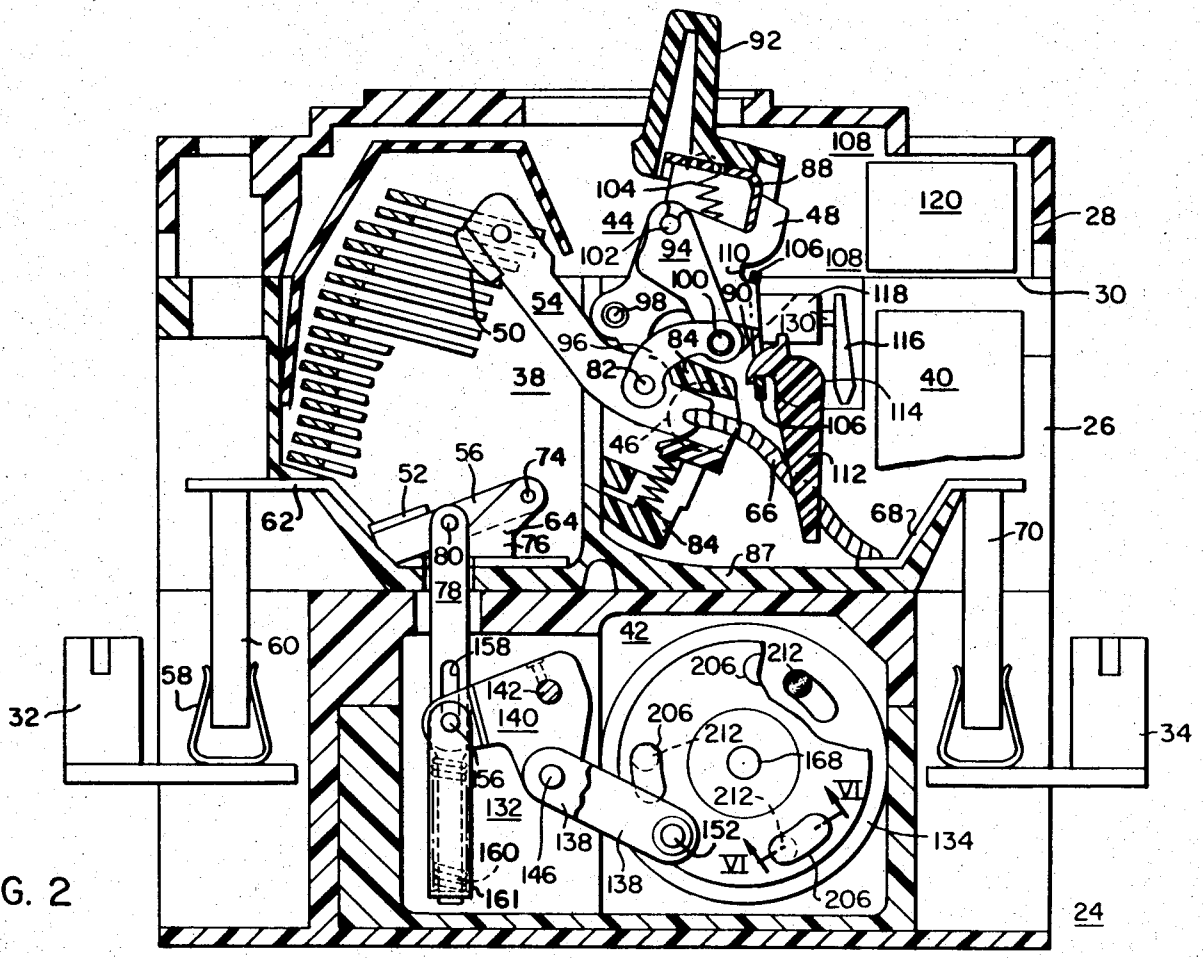
FIG. 2 is a vertical sectional view showing the circuit breaker in the open circuit condition.

Generally, the circuit breaker and contactor disclosed herein is similar in operation to that shown in above-mentioned application Ser. No. 759,718, filed July 29, 1985. In FIGS. 1 and 2 a molded case circuit interrupter is generally indicated at 24 and includes a molded, electrically insulating housing or base 26 having a cover 28 which is mechanically attached at a parting line 30 where it is retained in place by a plurality of fasteners such as screws (not shown). A line terminal 32 is disposed at one end of the housing 26 and a load terminal 34 is disposed at the other end. The circuit interrupter 24 may be used either as a single phase or a polyphase structure, such as a three phase or three pole circuit interrupter. For a polyphase circuit breaker, a pair of similar terminals 32, 34 are provided for each phase. The terminals 32, 34 are employed to serially electrically connect the circuit interrupter 24 into an electrical circuit, such as a three phase circuit, to protect the electrical system involved.

As shown in FIG. 2, the circuit interrupter 24 includes a circuit breaker generally indicated at 38, a modular sensor or current transformer module 40, and an electromagnetic actuator 42. The circuit breaker 38 comprises an operating mechanism 44, a tie bar 46, a cradle or releasable lever 48, and a pair of separable contacts 50, 52 mounted on upper and lower contact arms 54, 56. When the contacts 50, 52 are closed, a circuit through the circuit interrupter extends from the terminal 32, through a receptacle 58, a stab conductor 60, a conductor 62, a mounting bracket or shunt connection 64, the parts 56, 52, 50, 54, a shunt 66, a conductor 68, a stab conductor 70 and a receptacle 72 to the terminal 34.

The lower contact arm 56 is pivotally mounted on the bracket 64 by a pin 74. In addition, a link 78 is pivotally connected by a detachable pivot pin 80. The upper contact arm 54 is pivotally connected at a pin 82 to a rotating carriage 84, which is secured to or integral with the insulating tie bar 46. The contact arm 54 and the carriage 84 accordingly rotate as a unit with the tie bar 46 during normal current conditions through the circuit breaker 38.

The operating mechanism 44 is positioned in the center pole unit of a three pole circuit breaker and is supported between spaced plates (one of which plates 86 is shown) which are fixedly secured to the bottom wall 87 of the housing 26 at the center pole unit. An inverted U-shaped operating lever 88 is pivotally supported on the plates 86 with the ends of the legs of the lever supported in U-shaped notches 90 of the plates.

The U-shaped operating lever 88 has a handle 92 for manual operation of the mechanism 44. The mechanism 44 also comprises an overcenter toggle having an upper toggle link 94 and a lower toggle link 96 which connect the contact arm 54 to the releasable lever 48 that is pivotally supported on plate 86 by means of a pin 98. The toggle links 94, 96 are pivotally connected by means of a knee pivot pin 100. The toggle link 94 is pivotally connected at pin 102 to the cradle 48 and the link 96 is pivotally connected to the rotating carriage 84 at the pivot pin 82. Overcenter operating springs 104 are connected under tension between the knee pivot pin 100 and the bight portion of the lever 88.

Contact 50, which performs the circuit breaker function of the integral breaker/contactor, is normally manually moved to the closed position by movement of the handle 92 in a leftward direction (FIG. 1) from the OFF to the ON position. That operation obtains so long as a latch lever 106 of a trip bar assembly 108 is lodged in a notch 110 of the cradle 48. The trip bar assembly 108 includes a plurality of trip bars 112, such as three, one for each phase. The trip bars are preferably comprised of molded electrically insulating material and are either fixedly mounted or an integral part of a trip bar axis 114. The trip bar assembly also comprises a trip lever 116 and a solenoid 118. When the solenoid 118 is actuated, the solenoid plunger engages the trip lever 116 so that the trip bar 108, 112 and 116, rotates clockwise about its axis 114, releasing the lower end of the latch lever 106, allowing latch lever 106 to rotate clockwise and causing the upper end of latch lever 106 to move off the notch 110 of the cradle 48.

For the purpose of this invention, the circuit breaker operating mechanism 44 is tripped solely by the solenoid 118 (FIG. 1) in response to a signal from a trip unit 120 which in turn is connected to a coil 122 in the modular sensor 40. The coil 122 (FIG. 7) encircle the conductor 68 for monitoring the current flow therethrough. When a predetermined overload current passes through the conductor 68, the solenoid trips the operating mechanism 44. For that purpose the trip unit 120 includes a diode 124 and a resistance 126. A coil 128 of the solenoid 118 is connected to the circuit in the trip unit, whereby a solenoid plunger 130 is actuated against the trip lever 116.

The modular sensor 40 is detachably mounted within the housing 26 of the circuit interrupter 24, whereby it is removably mounted for replacement by a modular sensor of a different rating, or by a unit having overload current monitoring means, such as a bimetal or thermal magnetic devices. The trip unit 120 is preferably disposed within the cover 28 where it is electrically connected to the sensor 40. In the alternative the trip unit may be an integral part of the modular sensor 40 particularly where the sensor is of the type having the coil 128.

Contact arm 56, which performs the contactor function of the integral breaker/contactor, is actuated and moved to the closed position when the electromagnetic actuator 42 is energized. To avoid or minimize the effect of shock, such as occurs on board a naval vessel, a land tank, or due to seismic vibrations caused by an earthquake, the shock resistant mechanism of this invention is provided with the electromagnetic actuator 42.

Figure 3:
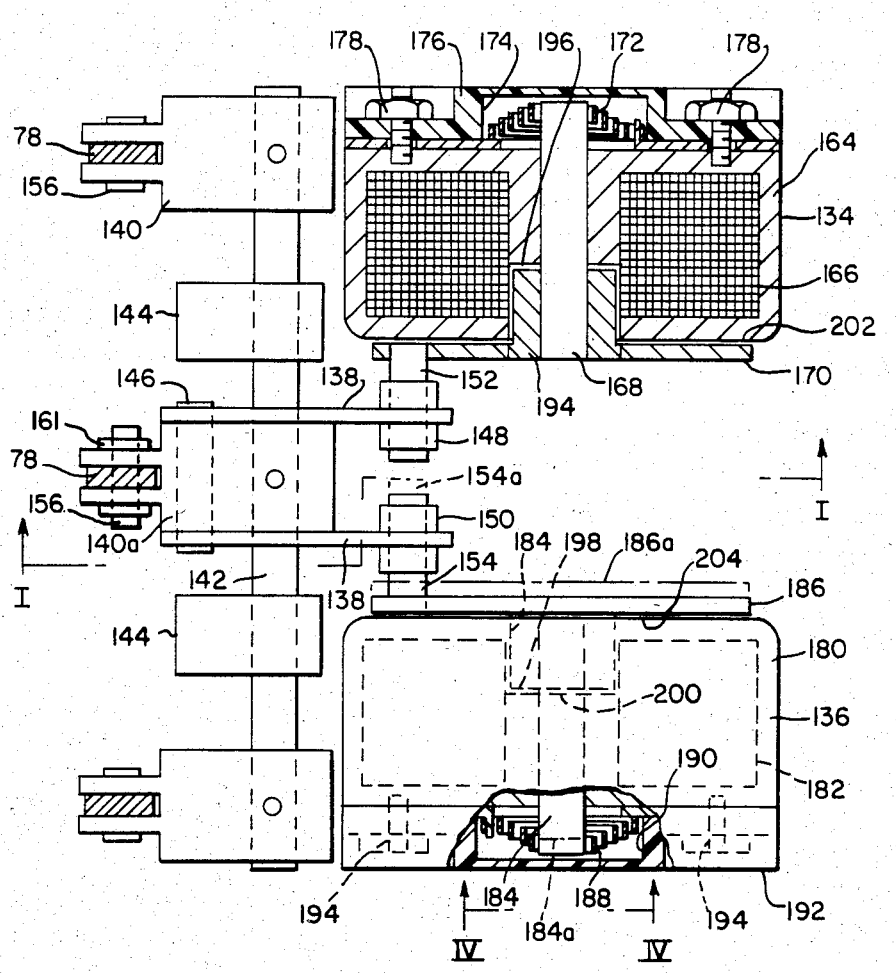
FIG. 3 is a horizontal sectional view, taken on the line III—III of FIG. 1.

In accordance with this invention, the electromagnetic actuator 42 comprises linkage means 132 and a pair of solenoids 134, 136 (FIG. 3) which through the linkage means is connected to the link 78 which is connected to the second contact arm 56 for raising and lowering the contact 52 with regard to the contact 50. The linkage means 132 includes a pair of links 138, a lever 140 for each phase (FIG. 3), and a tie rod 142. The tie rod is retained in place by a pair of spaced mounting brackets 144 which are suitably mounted on a portion of the housing. Each of the levers 140 is fixedly mounted on the tie rod 142 so that rotation of the tie rod through the central lever 140a rotates the levers 140. The lever 140a is rotated by spaced links 138 (FIG. 3), the left end of which links 138 are pivotally connected by a pin 146, and the right end of which links are provided with cylindrical bearings 148, 150 which, in turn, are mounted on separate shafts 152, 154.

When the links 138 move from the position of FIG. 1 to that of FIG. 2, the lever 140, being preferably a bellcrank, is rotated counterclockwise, causing a pin 156 to move against the lower end of a slot 158 in the link 78 and thereby lower the contact arm 56 to the position shown in FIG. 2. A coil compression spring 160 around the lower end of the link 78 bears against a shoulder 162 thereon and the U-shaped bracket 161 suspended from pin 156. The pressure of spring 160 against shoulder 162 causes the lower end of slot 158 in link 78 to bear against pin 156 whenever the lower contact 52 is clear of the upper contact 50. When the linkage is returning to the position shown in FIG. 1, this action of the spring 160 and U-shaped bracket 161 causes the link 78 to move upward in synchronism with the pin 156 until contacts 52 and 50 touch, at which time lever 140 continues to rotate clockwise a small amount, moving pin 156 away from the lower end of slot 158 and further compressing spring 160 by the same small amount.

Links and pins similar to the link 78 and pin 156 (FIG. 3) are provided for each of the levers 140 whereby the phases relating thereto are similarly actuated.

Though the solenoids 134, 136 respond to a signal from the modular sensor 40 for lowering the contact 52, they are primarily responsive to signals from remote locations for opening and closing the contacts. The solenoids 134, 136 are of similar contruction and oppositely disposed to operate in tandem. The solenoid 134 includes a case 164, a coil 166, and a plunger or armature 168. An armature plate 170 is mounted on the outer end of the armature and a spiral spring 172 is secured to the end of the armature opposite the armature plate 170. The spring 172 is housed within a circular cutout portion 174 of a mounting plate 176 on which the solenoid 134 is mounted by suitable means such as nut and bolt assembly 178. In a similar manner, the solenoid 136 includes a case 180 containing a coil 182. An armature 184 extends centrally through the solenoid and an armature plate 186 is mounted on the outer end of the armature 184. A spiral spring 188 is secured to the end of the armature 184 opposite the armature plate 186 and is contained within a cutout portion 190 of a mounting plate 192 to which the solenoid 136 is secured by means of nut and bolt assemblies 194. The mounting plates 176, 192 are fixedly mounted in a suitable manner on the housing 26.

The armature 168 includes an enlarged portion having an annular shoulder 194 which forms an air gap with an annular surface 196 of the case 134. Similarly, the armature 184 has an enlarged portion forming an annular shoulder 198 which faces an annular shoulder 200 of the case 180. Thus, when the coils are energized a linear electromagnetic flux closes an air gap between each pair of corresponding shoulders and thereby holds the respective armature plates 170, 186 in positions closely adjacent to surfaces 202 and 204, respectively, of the cases 164, 180. In addition, the shafts 152, 154 are fixedly mounted on the armature plates 170, 186, respectively.

In order to actuate the linkage means 132 between open and closed positions of the contacts 50, 52 the linear motion of the armatures 168, 184 of the solenoids 134, 136 is converted into rotary motion of the armature plates 170, 186, respectively. For that purpose, each solenoid employs a plurality of, such as three, ball bearing races 206 between each case and corresponding armature plate. More particularly, as shown in FIGS. 5 and 6, each race 206 comprises a pair of inclined surfaces 208, 210, and a ball bearing 212. The inclined surface 208 is disposed at an angle with respect to the surface 202 of the armature plate 170.

Likewise, the inclined surface 210 is disposed at an angle to a surface 214 of the case 134. The inclined surface 208 forms a deep end 216 of the race, and the inclined surface 210 forms a deep end 218 of the corresponding race. When the solenoid coil 166 is energized so that the armature plate 170 is adjacent to the case 134 (FIG. 5), the deep portions 216, 218 of the ball bearing race 206 are oppositely disposed with the ball bearing 212 disposed therein. On the other hand, when the coil 166 is deenergized, the armature plate 170 is spaced away from the case 134, such that a space 220 exists between adjacent surfaces 202 and 214, the deep ends 216, 218 are remote from each other and the ball bearing 212 is disposed at the opposite ends of the respective inclined surfaces 208, 210.

Each armature plate 170, 186 is rotated by the corresponding spiral spring 172, 188 (FIG. 4), the inner end of which is secured to the armature 184 and the outer end of which is secured at 193 to the mounting plate 192. When the coils 166 and 182 are deenergized, the electromagnetic forces within the solenoid cease and the contracted spiral springs 172 and 188 are free to expand and thereby rotate the armatures 168 and 184. The armature plate 170 rotates with the armature 168 causing the ball bearing races 206 move the armature plate 170 away from the case 164.

The foregoing operation for the ball bearing races 206 between the case 164 and the armature plate 170 also obtains for armature plate 186 and the case 180 of the solenoid 136.

More particularly, it is noted that the ball races of the solenoid 136 is reversibly inclined with respect to the ball races of the solenoid 134, whereby the armature plate 186 rotates in a direction corresponding to that of the armature plate 170. Thus, the pins 152, 154 move together to operate the linkage means 132.

Conversely, when the solenoids are re-energized, the armatures 168, 184 are moved longitudinally by the electromagnetic pull between the respective annular shoulders 194, 196 and 198, 200 to close the air gaps, therebetween causing the corresponding armature plates to rotate toward the respective cases and thereby move the linkage means 132 from the open contact positions of FIG. 2 to the closed contact position of FIG. 1. Thus, when the solenoids are energized, the contacts 50, 52 are closed, and when the solenoids are deenergized the contacts are open.

The resistance of the electromagnetic actuator 42 to the effect of shock, such as occurs on board a naval vessel, a land tank or due to seismic vibrations caused by an earthquake, is due to the use of the two solenoids 134, 136 and the particular linkage means 132. As shown in FIG. 1, when the contacts 50, 52 are closed, the axis of the link 138 is aligned with an axis extending through the aligned armatures 168, 184. More particularly, the pin 146 and an axis through aligned shafts 152, 154 are in colinear linkage with the axis through the algined armatures 168, 184. This co-linear linkage prevents rotation of the solenoid armature plates 170, 186 due to shock from any direction, which produces a substantial change in the force transmitted by links 138 to shafts 152, 154 because its line of action passes directly through their rotational axes.

Where a shock wave extends toward the circuit interrupter 24 in a direction that is substantially parallel to the longitudinal axes of the armatures 168, 184, the force of the shock may be sufficient to overcome the electromagnetic pull between the annular shoulders of one of the solenoids. For example, if a shock wave perpendicular to the axis of the armatures 168, 184 is directed (FIG. 3) toward the solenoid 136 from the side of the mounting plate 192 and having a force greater than the electromagnetic pull between the annular shoulders 198 and 200, the assembly of the armature 184 and the armature plate 186 move to the broken-line position **186*a* of the plate, which would result in enough separation of the ball races to permit the return spring 188 to rotate the armature 184 to its unenergized position. The force of this motion is transmitted through the shaft 154 which is slidably mounted in the bearing 150 to position 154***a*. Armature 168 would simultaneously be subject to the same shock wave, which in its orientation would tend to increase the force between the shoulders 194 and 196, preventing rotation of armature 168. Since the two armatures are linked together through shafts 152, 154, links 138 and pin 146, armature 168 will prevent the possible rotation of armature 184. As a result, such a shock wave, substantially perpendicular to the axis of the armatures 168, 184 will not actuate the linkage means 132 to open the contacts 50, 52.

When the solenoids 134, 136 are energized, an initial higher current is required to pull the armatures to the closed position of the contacts. However, once the contacts are closed, a reduced current is required to maintain the electromagnetic actuator 42 in the position shown in FIG. 1. This requirement is taken advantage of for economy purposes. For that reason, in the absence of the tandem arrangement of two solenoids as set forth above, any shock directed substantially longitudinally of the armatures 168, 184 sufficiently large to move the armature plate 186 to the broken line position 186*a* would allow the return spring to actuate the linkage means 132 to open the contacts 50, 52.

Accordingly, the circuit interrupter of this invention provides a unique linkage for coupling the rotary strokes of solenoids for operating the contacts on an integral circuit breaker/contactor mechanism intended for severe impact shock duty. Inasmuch as the linkage is proportioned so that the solenoids and the coupler link are colinear when the solenoids are energized, any back-driving effect on the solenoids from the spring forces or shock inertia forces is eliminated.

What is claimed is:

1. A circuit interrupter with shock-resistant mechanism, comprising:

an electrically insulating housing;

a circuit breaker having first and second separable contacts operable between open and closed positions;

the circuit breaker including a trip mechanism having a releasable lever movable when released to a tripped position to cause automatic opening of the contacts;

the first contact being mounted on a first arm coupled to the releasable lever;

the second contact being mounted on a second arm of which at least a portion is substantially parallel to the first arm to cause current limiting repulsion of the contacts in response to a predetermined overcurrent condition;

electromagnetic actuating means connected to the second arm for moving the second contact between open and closed positions relative to the first contact;

the electromagnetic actuating means comprising a pair of solenoids, each solenoid having a coil and an armature contained within a case including an apertured end wall and the armature extending through the end wall and the armatures being in substantial alignment, each armature having an armature plate integral with the end of the armature and external of the end wall, rotary means between each armature plate and end wall for rotating the armature plate when the armature moves longitudinally in response to operation of the armature coil;

the armature plates being oppositely disposed and having a common connection forming an assembly of the plates which is rotatable in tandem between first and second positions corresponding to the closed and open positions of the separable contacts;

linkage means between the armature plates and the second contact arm and including a coupler link pivotally connected at one end to a common connection between the armature plates for movement with the plates; and the longitudinal axis of the coupler link being in alignment with a line extending through the common connection and the rotational axis of the plates when the plates are in the first position so as to resist opening of the contacts when the circuit interrupter is subjected to vibrational shock waves.

2. The circuit interrupter of claim 1 in which the rotary means comprises a ball bearing race including inclined parallel ramps on facing surfaces of the end wall and armature plate and a ball bearing contained between the ramps.

3. The circuit interruption of claim 2 in which spring means are attached to each armature for simultaneous rotation of the armature plate assembly when the coils are deenergized.

4. The circuit interrupter of claim 3 in which spring means includes a spiral spring.

5. The circuit interrupter of claim 4 in which the contacts are in the closed position when the coils are energized.

6. The circuit interrupter of claim 5 in which the armature of one solenoid is movable longitudinally in response to a shock wave directed substantially longitudinally of the armature without rotating the assembly of the armature plates to the second position thereof.

7. The circuit interrupter of claim 6 in which the second arm is pivotally mounted on a support arm that is spring biased in the contact closed position and in which the linkage means includes a lever connected at one end to the link and at the other end to the support arm to effect movement of the second arm to the contact open position when the coils are deenergized.

8. The circuit interrupter of claim 7 in which said circuit interrupter includes a sensor means for monitoring current flow and for automatically actuating the electromagnetic actuating means and the releasing lever in response to another predetermined overcurrent condition.

* * * * *